US006763859B1

(12) United States Patent
Derheimer et al.

(10) Patent No.: US 6,763,859 B1
(45) Date of Patent: Jul. 20, 2004

(54) BLOW TUBE CONSTRUCTION

(75) Inventors: Neil E. Derheimer, Farmington Hills, MI (US); Robert J. Clark, Farmington Hills, MI (US)

(73) Assignee: Exotic Rubber & Plastics Corp., Farmington Hills, MI (US)

( * ) Notice: Subject to any disclaimer, the term of this patent is extended or adjusted under 35 U.S.C. 154(b) by 0 days.

(21) Appl. No.: 10/361,404

(22) Filed: Feb. 10, 2003

(51) Int. Cl.[7] ..... B22C 15/24
(52) U.S. Cl. ..... 141/71; 141/392; 164/200
(58) Field of Search ..... 164/200–202; 141/71, 114, 392

(56) References Cited

U.S. PATENT DOCUMENTS 2,423,341 A * 4/1947 Peterson
2,637,881 A * 5/1953 Peterson
2,687,559 A * 8/1954 Peterson
2,933,786 A * 4/1960 Peterson
3,104,432 A * 9/1963 Peterson
3,460,607 A * 8/1969 Olson
3,828,840 A * 8/1974 Lund et al.
3,903,952 A * 9/1975 Bego et al.
3,987,842 A * 10/1976 Chamdru
4,127,159 A * 11/1978 Chamdru et al. ..... 164/200
4,148,343 A * 4/1979 Damm et al.
4,460,032 A * 7/1984 Lund
4,570,694 A * 2/1986 Lund
4,643,240 A * 2/1987 Lund
4,836,269 A * 6/1989 Bellis et al. ..... 164/200
5,299,622 A * 4/1994 Doolin

* cited by examiner

*Primary Examiner*—Steven O. Douglas
(74) *Attorney, Agent, or Firm*—John K. McCulloch

(57) ABSTRACT

A blow tube for delivering particulate material from a container thereof to a mold to form a core has a unitary, elongate body formed of resiliently elastic material which enables the body to adjust and compensate for misalignment of the container and the mold. The blow tube body has a bore having a plurality of axially spaced sections so that when the particulate material is blown through the body by compressed gas, the density of the particulate material is increased and the velocity of the gas and particle stream is increased. The elasticity of the blow tube body enables the latter to expand in the event the particulate material clogs the blow tube, thereby enabling the clog to disaglomerate.

19 Claims, 2 Drawing Sheets

FIG - 4
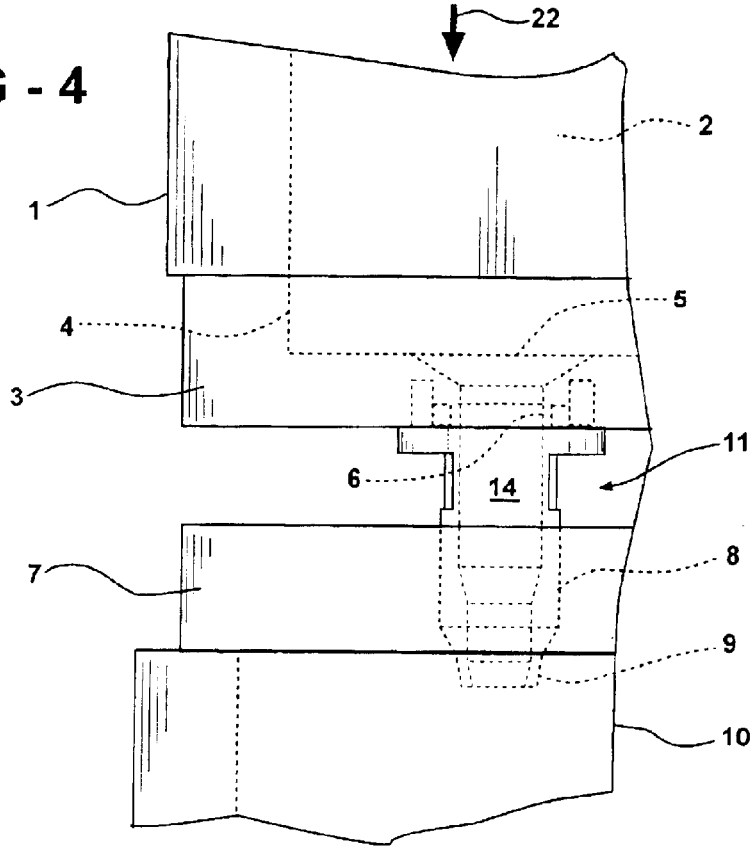
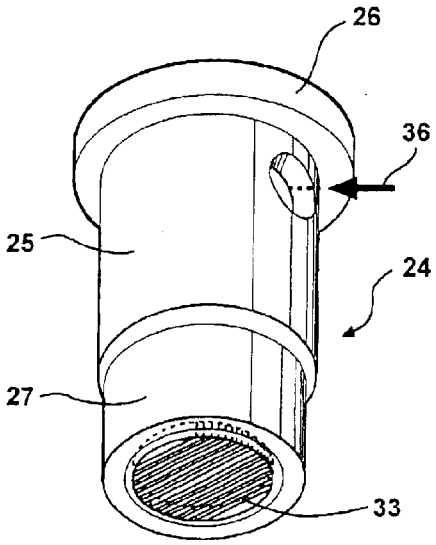
FIG - 5
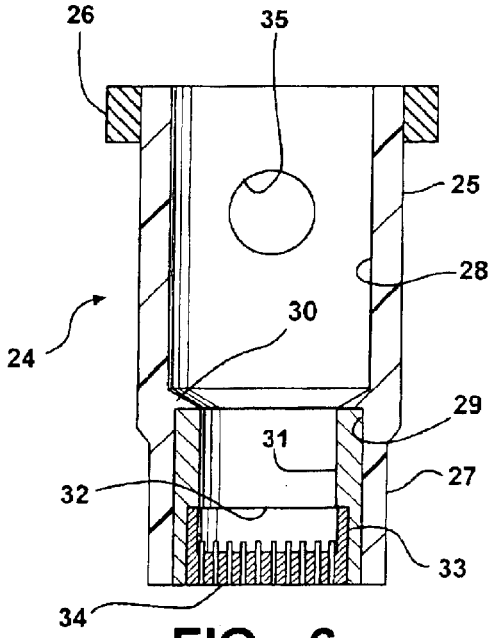
FIG - 6

BLOW TUBE CONSTRUCTION

This invention relates to a blow tube construction of the kind used in a foundry to inject particulate material and gas into a mold to form a core.

BACKGROUND OF THE INVENTION

Blow tubes of the kind with which the invention is concerned are used in high volume cold box and hot box core making machinery.

In common use in the foundry industry are blow tubes comprising a steel tube having a rubbery tip that removably snaps over one end of the tube. The rubbery tip creates a seal between the blow tube and the core box and minimizes wear at the tube/core box interface. Some difficulties exist with this type of blow tube. For example, the tips sometimes separate from their tubes, even though they may be changed frequently, thereby causing down time and labor for tip replacement. This can be a major economic issue.

There is no way to determine for certain when a tip is about to separate from its blow tube. Accordingly, some operators change them at the beginning of every shift so they will be less likely to separate during the shift. Other operators change the tips at regularly scheduled intervals, but they often separate anyhow thereby adversely affecting the production of cores and causing sand to be blown to areas other than into the mold.

Another problem with the use of metal blow tubes used to deliver sand from a blow plate to a core box is the damage that may result to the blow tube, or blow plate, or the core box when any misalignment between the blow tube and the core box occurs. In those instances in which a blow tube is misaligned with the inlet port to a mold cavity damage can occur to the blow tube, the core box, the blow plate or all of these components, thereby resulting in the necessity of making costly repairs, as well as rendering the machinery inoperable during the time required to make the repairs.

A further disadvantage of metal and non-elastic blow tubes is that, following the filling of a mold with sand, the passage of sand through the blow tubes is interrupted while the blow plate and core box are separated. In those instances in which the sand to be injected into a mold is mixed with a binder, as frequently is the case, bonding between sand particles occurs when the sand is at rest, i.e., not flowing through the blow tube. When such bonding occurs it is not uncommon to have to discontinue core production until such time as the bonded sand clumps are removed from a clogged blow tube or the blow tube itself is replaced.

A principal object of the invention is to provide a blow tube which overcomes or greatly minimizes the objectionable characteristics referred to above.

SUMMARY OF THE INVENTION

A blow tube constructed in accordance with a preferred embodiment of the invention comprises an elongate, tubular body having a bore extending axially therethrough. At one end of the body is a coupling ring which enables the body to be secured to an orifice plate forming part of a sand container and overlying a core box having a port plate through which sand from the container may enter the mold for the purpose of forming a sand core. The blow tube body is formed of a rubbery, elastic, resilient material which is capable of compensating for misalignments which may occur between the sand outlet of the sand container orifice plate and the inlet port of the core box port plate. That end of the blow tube which is adapted to enter the inlet port to the core box is externally tapered so as to facilitate a seal being effected between the tip of the blow tube and the inlet port.

Sand conventionally is delivered to the mold via a blow tube under the influence of both gravity and pressurized gas such as air. The pressurized gas enables the sand to be packed more densely and uniformly in the mold. The packing is improved with a blow tube according to the invention by tapering the blow tube bore in a direction toward the discharge end of the latter so as to accelerate the rate at which sand is discharged from the blow tube and increase the density of the sand in the mold.

The elasticity of the material from which the blow tube is made is such that, in the event the bore becomes clogged by bound-together sand particles following periods during which the sand is at rest in the blow tube, the pressurized gas will cause the body of the blow tube to expand radially so as to facilitate separation of the particles of the clogged sand from one another and be discharged. The effectiveness of the compressed gas in these circumstances is increased by the tapering of the bore through which the sand passes.

When a mold cavity is filled to the desired extent with sand it is sometimes desirable to tamp the sand to solidify the core. For this purpose a tamping pin similar in many respects to the blow tube is provided and comprises a tubular body having a bore extending axially therethrough and terminating at one end in a coupling ring similar to that provided on the blow tube. At the other or free end of the tamping pin body is a rigid sleeve fitted into the bore and such sleeve accommodates a grate which is flush with the free end of the pin. The grate has passages through which air or other gas may flow to react with whatever binder is mixed with the sand.

The tamping pin may be vibrated vertically to effect tamping of the sand in the mold. Accordingly, the grate is one which is so constructed as to be capable of applying a compressive force on the sand as the pin is vibrated.

THE DRAWINGS

The presently preferred embodiment of the invention is disclosed in the following description and in the accompanying drawings, wherein:

FIG. 4 is a fragmentary, elevational view illustrating a blow tube in an operative position between a sand container and a core box;

FIG. 5 is an isometric, elevational view of a tamping pin;

FIG. 6 is a vertical sectional view of the pin shown in FIG. 5; and

DETAILED DESCRIPTION

Figure 1:
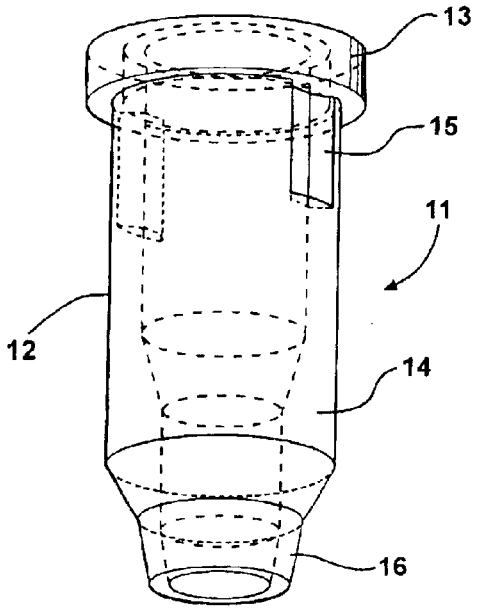
FIG. 1 is an isometric, elevational view of a blow tube.

Apparatus constructed in accordance with the invention is adapted for use in connection with conventional foundry apparatus as shown in FIG. 4 and comprising a container 1 having a chamber 2 for the accommodation of a mixture of particulate material such as sand mixed with a suitable, conventional binder. Fixed to the bottom of the container 1 is an orifice plate 3 having an upwardly facing cavity 4 at the bottom of which is a funnel-shaped opening 5 in communication with a port 6 through which sand may flow toward a port plate 7 having a port 8 which communicates via an inlet 9 with a core box 10. FIG. 4 discloses a blow tube 11 constructed according to the invention interposed between the orifice plate 3 and the port plate 7 for discharging material from the container 2 into the mold of the core box.

The blow tube 11 comprises a tubular, elongate, unitary body 12 formed of a suitable, elastic, butyl or other rubbery material having a durometer of about 80. At one end of the body 12 is a coupling ring 13 which may be secured adhesively to the body or molded within the body as is commonly done. The body 12 has a side wall 14 which is substantially uniform for the major portion of its length. However, adjacent the coupling ring 13 the wall is reduced to provide a pair of clearances 15 for the accommodation of the heads of bolts (not shown) which may be used to secure the tube to the orifice plate 3.

Adjacent its opposite or free end the body 12 is externally tapered to form a tip 16 of reduced diameter and wall thickness.

Extending axially through the body 12 is a bore 17 having a first, upper section 18 which is of uniform diameter throughout is length. However, at the lower end of the bore section 18 is a first tapered section 19 which communicates at its lower end with a second bore section 20 of uniform diameter.

The lower end of the bore section 20 communicates with a second tapered bore section 21 which is axially spaced from the first tapered section 19 and terminates at the free end of the body 12.

The tapers of the bore sections 19 and 21 preferably are different. Preferably, the bore section 19 taper is steeper than that of the bore section 21. Satisfactory results have been obtained when the bore section 19 has a taper of about 15° and the bore section 21 has a taper of about 10°.

To condition the blow tube for use, it is placed on the bottom of the orifice plate 3 and secured to the latter by bolts (not shown) whose heads may occupy partially the clearances 15. When properly installed, the heads of the bolt will bear against the coupling ring 13 and lock the blow tube in a position in which its upper bore section 18 is in register with the outlet of the orifice plate passage 6. The blow tube 11 thus will be fixed securely to the container 1 and extend beyond the orifice plate 3 it a direction toward the core box 10. The container 1 and the core box 10 preferably will be arranged in such manner that the blow tube is in axial registration with the port 8 of the port plate 7, thereby facilitating the flow of sand from the container 2 into the mold in the core box 10. The flow of sand is facilitated by pressurized gas, such as air, from a source indicated by the arrow 22 in FIG. 4 into the interior of the container 2, as is conventional.

Once a predetermined quantity of sand has been delivered to the mold in the core box, the container 1 and the core box are displaced so as to enable another core box to be placed beneath the container 1 in a position to receive sand from the blow tube 11.

Constructing the blow tube 11 of resiliently elastic material and tapering the tip 16 enable minor misalignments between the outlet and inlet of the container 1 and core box 10 to be compensated for inasmuch as the entire body 12 of the blow tube is capable of flexing to enable the tapered tip 16 to form a seal with the inlet 9 of the mold box. Because of the ability of the body 12, including the tip 16, to flex there will be no damage to the blow tube or to the container 1 and mold box 10 because of misalignment therebetween. The material from which the blow tube is formed is of such resilience as to enable it to return to its initial configuration once the application of lateral and other forces thereon is terminated.

When the discharge of sand through the blow tube 11 terminates for any one of a number of reasons, such as when a filled mold box is replaced by an empty mold box, the sand in the bore 17 is at rest. If the sand is mixed with a binder, as is frequently the case, the binder may have a tendency to cause the sand particles to bond to one another or to the sidewall of the bore 17. If the interruption of the flow of sand through the blow tube is prolonged, or if the temperature and humidity conditions are appropriate, the bonding of the sand particles to one another or to the bore 17 may cause the bore to become clogged. In this event reinitiating the flow of sand from the container into the blow tube 11 will enable the pressurized gas to exert such force on the clogged particles as to cause the sidewall 14 of the blow tube to expand radially, thereby enabling the clog to disagglomerate and pass through the body 12. The thickness of the sidewall of the body 12 will depend upon the particle size of the sand, the binder used, and the pressure under which the gas is introduced to the blow tube. These characteristics easily may be determined empirically.

Figure 2:
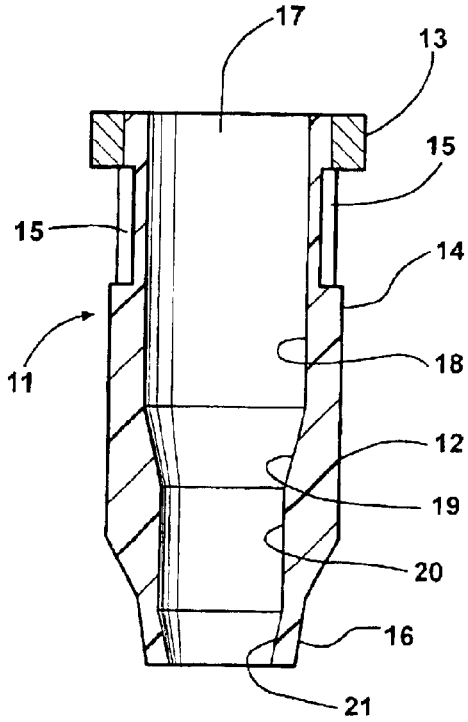
FIG. 2 is a vertical sectional view of the tube shown in FIG. 1 and taken on line 2—2 of FIG. 3.
Figure 3:
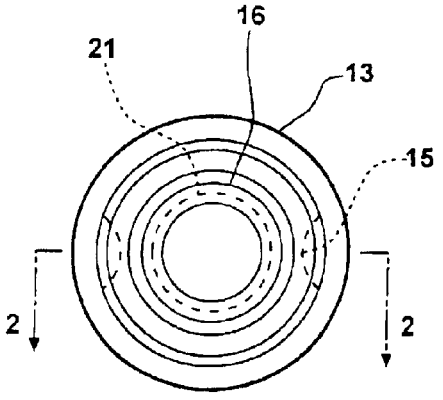
FIG. 3 is a bottom plan view of the blow tube.
Figure 7:
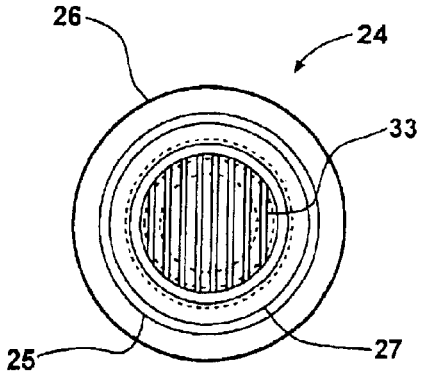
FIG. 7 is a bottom plan view of the pin shown in FIG. 5.

As is best shown in FIG. 2 the wall thickness of the tapered tip 16 is less than any other wall thickness of the body, with the possible exception of the wall thickness at the clearances 15. The reduced wall thickness of the tip facilitates the accommodation of the tip in an inlet port even though there may be some misalignment between the body 12 and such port.

As sand flows through the bore 17 under the influence of gravity and the pressurized gas, the volume of gas will be compressed and its velocity increased as it flows successively through the tapered bore sections 19 and 21. These characteristics will increase the density of the particulate material discharged from the blow tube. As a result, the core formed in the mold will have a greater density than otherwise.

Following the filling of a mold it sometimes is desirable to tamp the sand so as to eliminate voids and thereby improve the density of the core. Apparatus constructed in accordance with the invention includes a tamping pin 24 comprising an elongate, tubular body 25 formed of elastic material corresponding or similar to that from which the blow tube body 12 is formed. At one end of the body 25 is a coupling ring 26. The body 25 terminates at its opposite end in a reduced thickness wall section 27. The tamping pin 24 has an upper bore section 28 of substantially uniform diameter which communicates at its lower end with a second bore section 29 of reduced diameter. Between the bore sections 28 and 29 is an annular projection 30 which forms a shoulder.

Press fitted into the bore section 29 is a metal sleeve 31 which seats on the shoulder provided by the projection 30. Between its ends the sleeve 31 has an internal shoulder 32 on which seats one end of an annular grate 33 press fitted in the sleeve and having a plurality of axially extending gas passages 34 therein. The lower force of the grate 33 is flush with the free end of the pin 24.

In the disclosed embodiment the sidewall 25 of the pin 24 has an opening 35 in communication with a source of compressed air or other gas represented by the arrow 36 in FIG. 5.

In use, the tamping pin 24 is fitted to an overhead support (which could be the container 1) and which is vertically positioned over the core box 10 in register with the inlet orifice 9 of the core box. The tamping pin 24 and the core box 10 are vibrated relative to one another so as to enable the tamping pin to compact the sand in the mold. If desired, air or other gas may be introduced to the interior of the tamping pin body 25 via the opening 35 so as to prevent clogging of the openings in the grate 33 and to enable the gas to react with the binder which may be mixed with the sand to effect curing or other reaction of the binder.

The disclosed embodiment is representative of a presently preferred form of the invention, but is intended to be illustrative rather than definitive thereof. The invention is defined in the claims.

We claim:

1. A blow tube construction adapted for use in a foundry for injecting particulate material and gas into a mold to form a core, said construction comprising a unitary, tubular, elastic body having a bore extending axially therethrough and terminating at one end in a tip; and coupling means secured to said body at its opposite end for coupling said body to a source of said material and gas, said tip being externally tapered in the direction of said one end, said bore having between its ends two sections one of which terminates at said one end of said body and the other of which is axially spaced from said one of said sections, each of said sections tapering in a direction toward said one end of said body.

2. The construction according to claim 1 wherein said tip has a wall thickness less than that of the body at a zone adjacent said tip.

3. The construction according to claim 1 wherein the taper of one of said sections is steeper than that of the other.

4. The construction according to claim 3 wherein the steeper taper is said other of said sections.

5. The construction according to claim 1 wherein said coupling means comprises a ring adhesively secured to said body.

6. The construction according to claim 1 wherein said coupling means comprises a ring embedded in said body.

7. The construction according to claim 1 wherein said tip has a sidewall thickness less than that of an adjacent sidewall section.

8. A blow tube construction adapted for use in a foundry for injecting a mixture of sand and a binder under pressurized gas into a mold to form a core, said construction comprising a tubular, elastic body having a bore extending axially therethrough, said bore having two axially spaced, tapered sections therein, said body terminating at one end in a tip tapering in the direction of said one end; and coupling means secured to said body at its opposite end for coupling said body to a source of said mixture and pressurized gas, said binder having a tendency to bind particles of said sand to one another when said mixture is at rest in the bore of said body, the force applied on said mixture by said pressurized gas and the elasticity of said body being such as to enable said bore to expand, thereby dislodging particles bound together by said binder following a period when said mixture is at rest.

9. The construction according to claim 8 wherein said body is formed from a butyl rubber having a durometer of about 80.

10. The construction according to claim 8 wherein said tip has a wall thickness less than that of the body adjacent said tip.

11. The construction according to claim 8 wherein the taper of one of said sections is steeper than that of the other.

12. The construction according to claim 11 wherein the steeper tapered section is said other of said tapered sections.

13. A blow tube tamping pin construction adapted for use in a foundry to compact particulate material in a mold to form a core, said construction comprising a tubular, resilient, elastic body having an axially extending bore therethrough, one end of said body having a wall thickness less than that of the remainder of said body; a rigidifying sleeve fitted into said body at said one end of said bore; a grate fitted into said sleeve at said one end of said bore; a and a gas passage in communication with said bore for introducing pressurized gas into said bore for discharge through said grate, said grate having one end thereof flush with said one end of said body so as to be engageable with particulate material occupying said mold.

14. The construction according to claim, 13 wherein said bore has a shoulder between its ends on which said sleeve seats.

15. The construction according to claim 13 wherein said bore at said one end of said body is reduced in cross-sectional area by the presence of said sleeve.

16. A blow tube construction adapted for use in a foundry for injecting particulate material and gas into a mold to form a core, said construction comprising a unitary, tubular, elastic body having a bore extending axially therethrough and terminating at one end in a tip; and coupling means secured to said body at its opposite end for coupling said body to a source of said material and gas, said tip being externally tapered in the direction of said one end, said bore having at least one section axially spaced from said tip which tapers in a direction toward said tip.

17. The construction according to claim 16 wherein said bore has between said one section and said one end of said body a second section tapering in the direction of said one end of said body.

18. The construction according to claim 17 wherein the taper of one of said sections is steeper than that of the other.

19. The construction according to claim 18 wherein the steeper taper is said one section.

* * * * *